US006260312B1

(12) United States Patent
Spene et al.

(10) Patent No.: US 6,260,312 B1
(45) Date of Patent: Jul. 17, 2001

(54) PREFABRICATED EMERGENCY SHELTER

(76) Inventors: Chris A. Spene, 8158 Racine Tr., Austin, TX (US) 78717-5344; Dean W. Morgan, 419 Lake Point Dr., Marble Falls, TX (US) 78654

( * ) Notice: Subject to any disclaimer, the term of this patent is extended or adjusted under 35 U.S.C. 154(b) by 0 days.

(21) Appl. No.: 09/132,047

(22) Filed: Aug. 11, 1998

(51) Int. Cl.[7] ..... E04H 9/14

(52) U.S. Cl. ..... 52/169.6; 52/169.1; 52/79.1; 52/19

(58) Field of Search ..... 52/79.1, 169.1, 52/169.6, 169.7, 19

(56) References Cited

U.S. PATENT DOCUMENTS

| | | | | |
|---|---|---|---|---|
| 3,093,098 | * | 6/1963 | Rosenfeld | 52/169.6 X |
| 3,778,528 | * | 12/1973 | Heifetz et al. | 52/79.1 X |
| 3,938,284 | * | 2/1976 | Broadbent et al. | 52/169.6 X |
| 4,238,858 | * | 12/1980 | Maihart | 52/79.1 X |
| 4,534,144 | * | 8/1985 | Gustafsson et al. | 52/169.6 |
| 4,539,780 | | 9/1985 | Rice | 52/169.6 |
| 4,615,158 | | 10/1986 | Thornton | 52/169.6 |
| 4,670,623 | * | 6/1987 | Siffrin | 52/169.6 X |
| 4,955,166 | * | 9/1990 | Qualline et al. | 52/169.6 |
| 5,022,202 | * | 6/1991 | Johnson | 52/79.1 X |
| 5,115,613 | * | 5/1992 | McCarthy | 52/169.6 |
| 5,315,794 | * | 5/1994 | Pearson | 52/169.6 X |
| 5,481,837 | | 1/1996 | Minks | 52/169.6 |
| 5,749,181 | | 5/1998 | Bauman | 52/169.6 |
| 5,773,756 | * | 6/1998 | DiTullio | 52/79.1 X |
| 5,809,936 | * | 9/1998 | Wall | 52/169.6 X |
| 5,852,901 | * | 12/1998 | Meyers | 52/79.1 X |
| 5,930,961 | * | 8/1999 | Beaudet | 52/169.6 |
| 5,953,866 | * | 9/1999 | Poole | 52/19 X |
| 5,979,128 | * | 11/1999 | Parsons | 52/19 X |

* cited by examiner

*Primary Examiner*—Beth A. Stephan
*Assistant Examiner*—Brian E. Glessner
(74) *Attorney, Agent, or Firm*—Rick B. Yeager

(57) ABSTRACT

An emergency shelter to be used under the floor of a residential or commercial structure. In the preferred embodiment, a prefabricated acrylic shelter is sized to accommodate at least one individual in a crouching or sitting position. The shelter is placed prior to the pouring of a slab foundation or the building of the floor in a pier and beam foundation. The unit is sealed to prevent moisture infiltration and provides the benefits of a relatively pleasant surface without the accumulation of moisture. Additional advantages are the relative lower expense, light weight, and ease of installation of the prefabricated shelter. Other uses of the shelter include security and storage.

12 Claims, 5 Drawing Sheets

PREFABRICATED EMERGENCY SHELTER

FIELD OF INVENTION

This invention relates to prefabricated storm shelters.

BACKGROUND

Underground storm shelters have proven to be effective shelters for tornados in many parts of the country. Buried or partially buried storm shelters have been used for many years. The difficulties of incorporating buried storm shelters in residential constructions and neighborhoods include the expense, the lack of space associated with the standard lot, and the presence of shallow bedrock in many areas. The fabrication of traditional storm shelters is also relatively expensive.

The recommended procedure for tornado alerts in many parts of the country is for the residents to move to the center part of their house, such as an interior bathroom or closet. While this strategy is generally effective, there are cases of extremely high winds where residents are not safe in any part of the house and where the only practical effective shelter is one that is below the foundation of the home or buried in the vicinity of the home.

The most common material of construction of existing storm shelters is concrete, which may either be prefabricated in one or more sections for site assembly; or poured in place structures. Although the concrete shelters are strong, there are several disadvantages to that material including difficulty and expense of installation, weight, long-term water resistance, and interior moisture condensation.

An object of the current invention is to provide a storm shelter to be installed below the floor level of a home for use in an emergency. Another object of the invention is to provide a shelter that can be installed without limitations of lot size or easement restrictions.

It is a further object of the present invention to provide a shelter that requires limited excavation.

It is a further object of the present invention to provide such a shelter in a relatively inexpensive prefabricated form.

It is a further object of the present invention to provide a material of construction which is water resistant, which will minimize condensation on the interior of the shelter, and which will provide a shelter that is relatively impervious to water seepage from the outside.

It is a further object of the present invention to provide a shelter with interior surfaces which are smooth, sturdy, corrosion-free, and pleasant.

It is a still further object of the invention to provide an underground emergency shelter system that accomplishes all or some of the above objects in combination.

It is an object of the present invention to provide a prefabricated shelter of a material which is lighter and easier to install than precast concrete. It is a further object of the present invention to provide a shelter which can be built into new construction in a manner which permits entry from the interior of the home. In the current invention it is desirable to place the unit below the floor lever for maximum safety and security.

It is an object of the preferred embodiment of the invention to provide a lightweight underground emergency shelter system and may be anchored by a house foundation without requiring a separate and elaborate anchoring apparatus.

An object of the present invention is to provide a prefabricated shelter which can be constructed with materials such as acrylic which is used in conventional tubs and spas, and which can be fabricated by vendors such as tub and spa vendors. It is a further object of the present invention to provide prefabricated units which can be handled without special equipment such as cranes.

An object of the present invention is to provide a pleasant interior surface in a single unit without requiring an exterior support frame.

One object of the present invention is to provide a smaller and more affordable emergency shelter which does not require elaborate anchoring.

U.S. Pat. No. 4,955,166 for a "Tornado underground shelter" issued on Sep. 11, 1990 to Steve M. Qualline and Louis R. Dunnam describes a large, generally spherical tornado shelter with a seat member is attached to the sidewall and floor which forms a structural member that strengthens the globe. The patent describes disadvantages of concrete structures shrinkage, cracking, and becoming saturated with moisture such that the interior is unsuitable for habitation or storage. The shelter provides standing headroom for its occupants. The '166 patent references a second embodiment of incorporating the large spherical structure into the floor of a home with the entrance above the floor level of the home. The patent also references placing the structure under a patio with the stairway extending at least three steps above the top surface of the patio, thereby precluding someone inadvertently falling through the open door thereof. An object of the present invention is to provide a relatively inexpensive prefabricated structure of more practical size that can be incorporated more readily into conventional home designs without increasing the foundation size of home.

SUMMARY OF THE INVENTION

In the preferred embodiment of this invention, a prefabricated storm shelter with a top entrance of approximately 28 inches square is installed below the foundation or floor of a residence. Fabrication of the unit is preferably in a top section and a bottom section with the unit sealed along its side surfaces to prevent moisture intrusion. The unit is typically composed of a material such as acrylic upon a reinforced fiberglass to provide structural integrity and a relatively pleasant interior finish. The shelter is designed to be placed so that the entrance way is at the floor level of first floor of a residential or commercial structure having a concrete slab foundation. Alternately, the unit may be placed so that the hatch is at the floor level of a pier and beam foundation.

BRIEF DESCRIPTION OF DRAWINGS

These and other objects and advantages of the present invention are set forth below and further made clear by reference to the drawings, wherein.

DESCRIPTION OF THE PREFERRED EMBODIMENT

The preferred embodiment of the shelter is designed for installation below a concrete slab foundation of a residential structure.

Figure 1:
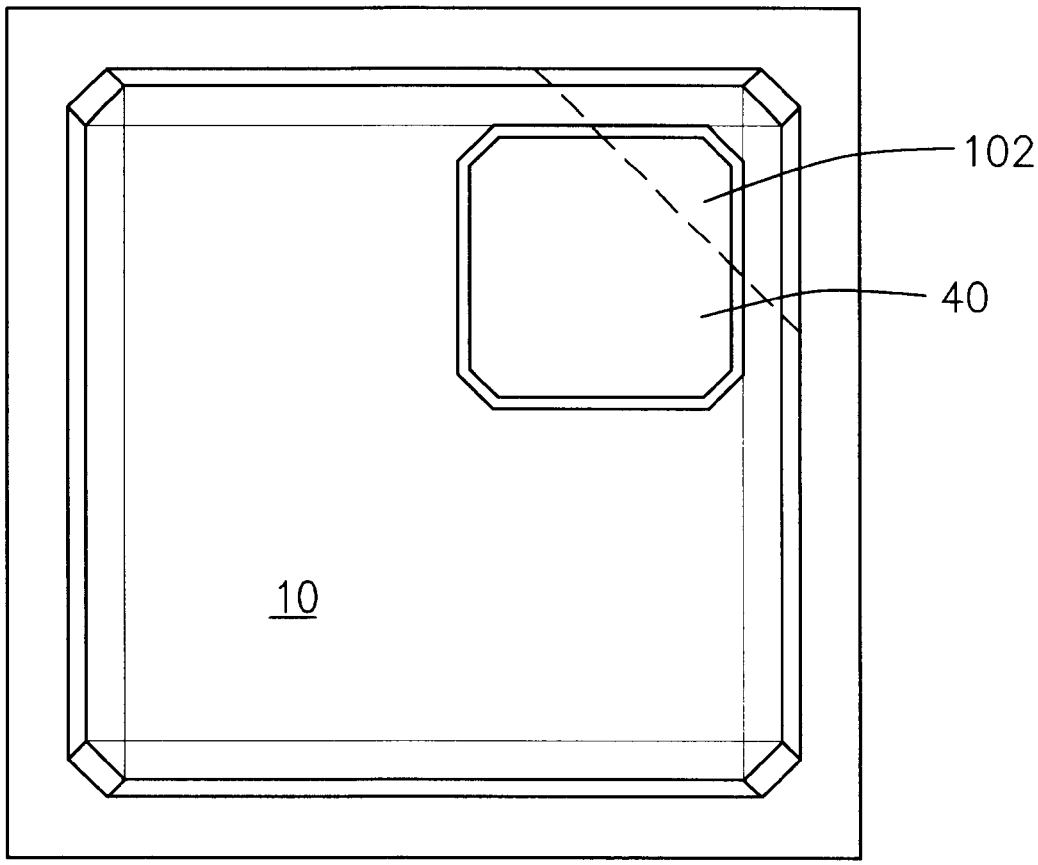
FIG. 1 is a top view of the shelter.
Figure 2A:
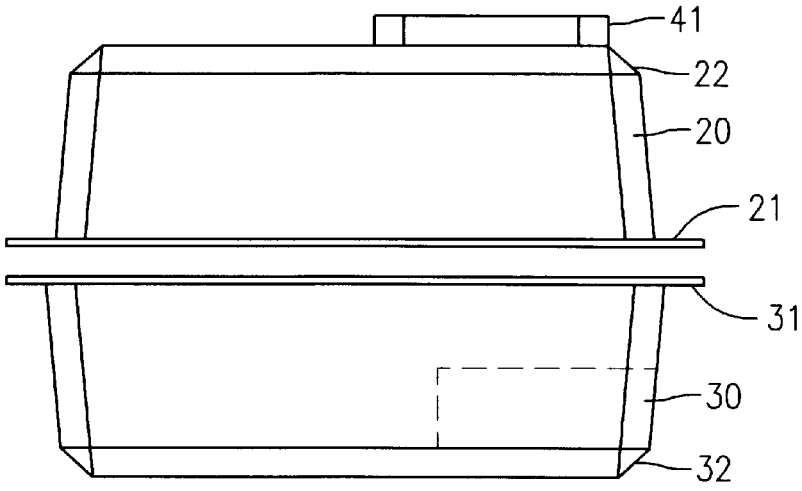
FIG. 2A is an exploded side view of the shelter.

Referring now to FIG. 1 which is a top view of the preferred embodiment, and to FIG. 2, which is a side view of the preferred embodiment, the shelter 10 is approximately 6 feet in width and 6 feet in length and has a height of at least 36 inches. Greater lengths and widths may be used in cases where additional space is required. Greater heights may by used, and a height of 42 inches is an approximate height to permit a relatively convenient crouching or sitting for a temporary stay during an event such as a tornado or thunderstorm. These dimensions are smaller than a typical storm shelter in order to provide a practical and affordable emergency shelter. The dimensions permit the shelter to be installed within the foundation area of a home with low additional excavation costs. In addition to lower installation costs, the smaller dimensions permit the shelter cost to be lower than other types of larger shelters. The shelter is preferably composed of a top section 20 and a bottom section 30. The top section has a lip 21 which is fastened to the bottom section lip 31 during assembly to create a single unit. The top section contains a hatch 40 which is typically located near a side wall so that a prefabricated step 101 may be used to assist a person in entering and exiting the shelter. The opening of the hatch is preferably at least 28 inches by 28 inches. The hatch includes a riser section 41 that is typically about 5" above the top of the upper section. This height allows room for a layer of sand and the thickness of a typical concrete slab.

The unit is preferably assembled at the factory or dealer, but it can also be assembled on site as described in the alternate embodiment.

Figure 3:
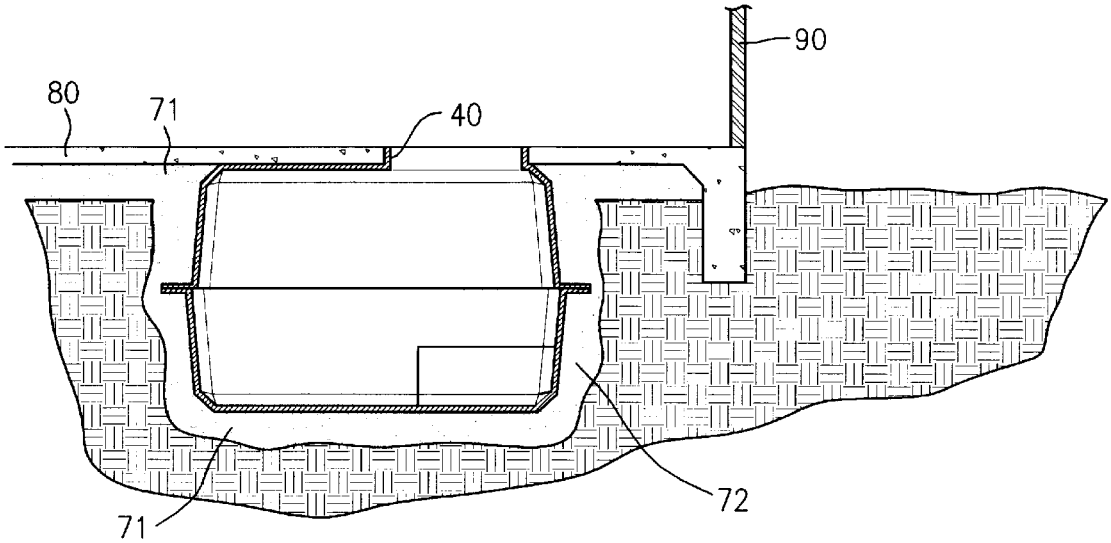
FIG. 3 is a detailed side view of the installation of the shelter in a typical slab foundation.

Referring now to FIG. 3, the unit is preferably installed so the top of the hatch is located at the floor level of a slab. The floor 80 is poured level around the hatch 40. This hatch is typically located in a closet near an exterior wall 90. The reason for locating the hatch in a closet is for cosmetic purposes. One reason for locating the hatchway near an exterior wall is the ability to vent the unit through an exterior wall. An additional benefit to placing the unit near an exterior wall is to permit easier reference points for placing and aligning the unit within a foundation.

Referring now to FIG. 2 which is a cross section of the preferred embodiment, the shelter is preferably fabricated with a vacuum molding process similar to the process for fabricating tubs and spas. The bottom section is preferably fabricated in a female mold where a hot acrylic sheet with a thickness of approximately ⅛" is placed over the mold, and a vacuum drawn on the mold to form the hot sheet to conform to the bottom section mold. The bottom edges are beveled 32 to avoid sharp comers and edges in order to support this vacuum forming process, to avoid stress points on the completed section, and to provide improved comfort within the shelter. Alternate resin materials may be used including ABS, PVC, polyethylene, and fiberglass reinforced gel coat.

The top section is preferably fabricated in a male mold where a hot acrylic sheet is placed over the mold, and a vacuum drawn on the mold to form the hot sheet to conform to the top section mold. The top edges are beveled 22 to avoid sharp corners and edges in order to support this vacuum forming process and to avoid stress points on the completed section. Both the top section and the bottom section can be fabricated in either a male mold or a female mold.

The vacuum forming process produces thin shells of the upper and lower shelter sections. These shells are reinforced by applying a fiberglass resin material to a thickness of about ¼", with additional material provided at stress points. The preferred method of applying the fiberglass reinforcement is to spray a cut fiberglass/resin composition to the back side of the shells. The preferred composition is 18% glass, 1.5% catalyst, and 80.5% resin. Structural coring can be placed within the laminated fiberglass to add structural strength.

Figure 5:
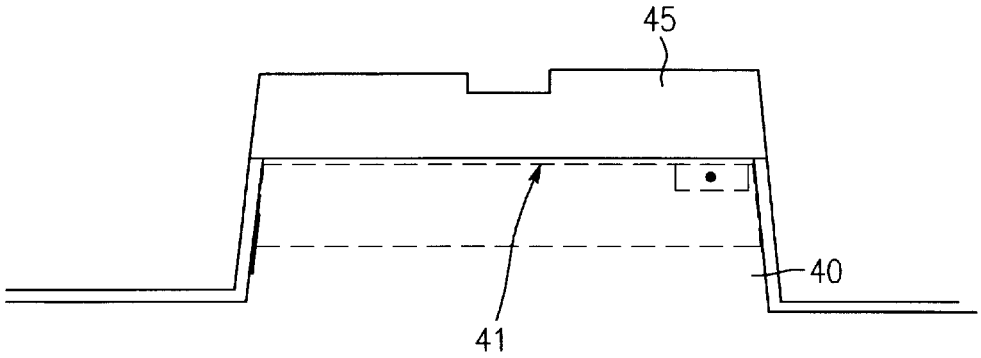
FIG. 5 is a side view of illustrating the removal of a lid from the molded upper section.

Referring now to FIG. 5 which is a side view of the top section showing the molded hatchway area, the top hatch is formed as a closed section approximately seven inches above the top of the upper section. In order to form the hatchway 40, the hatched top is cut approximately two inches below this extension. Hinges 43 are used to mount this cut away section 45 so that it opens by swinging downward into the shelter. In the preferred embodiment, a step is formed on the bottom shell, and the hinges are mounted on the opposite side of the hatch from where the step is located so that the hatch can be fully opened without obstruction. There are several advantages to and inward opening door including resistance to suction and the ability to open the door if debris falls over the door opening.

Figure 6:
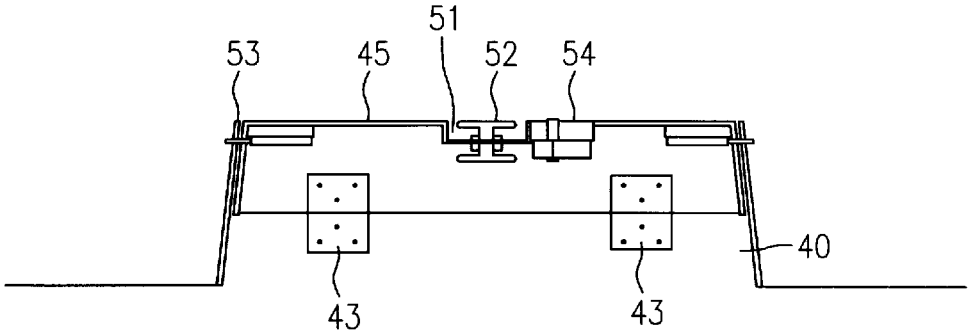
FIG. 6 is a side view of the shelter lid.

Referring now to FIG. 6 which is a side view of the top section showing the installed hatch lid 45, the lid is mounted with two hinges 43. The lid is latched by spring loaded latch bolts 53 which extend into recesses in the hatch opening. The lid is recessed 51 for a diameter of about 4–5" diameter and 1 to 1.5 inch deep for a handle 52, which is preferably a garage door-type mechanism. The spring loaded latch bolts 53 are moved into a retracted position when the handle is turned, thereby permitting the hatch to be opened. A lock 54 is typically provided to restrict entry into the shelter.

Figure 7:
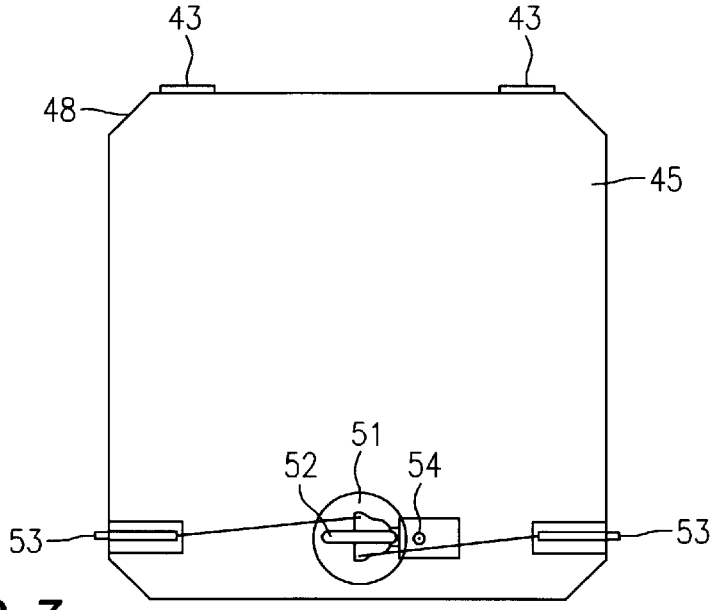
FIG. 7 is a top view of a latch mechanism.

Referring now to FIG. 7, the preferred dimensions of the hatch opening is 28 inches by 28 inches. The hatch comers 48 are beveled to permit construction by the vacuum molding process. The top hatch extension is formed with a draft angle of approximately five degrees to permit the top lid section 45 to be removed from the mold. This draft angle causes the hatch to be slightly smaller in dimension than the hatch opening, and a gasket is provided for sealing the hatch. After the vacuum forming process, a foam or wood backing is placed for reinforcement upon the acrylic before the fiberglass application. This reinforcement adds strength to the Hatch lid so that the lid will withstand a static or dynamic load. The reinforcement also provides a depth that permits the handle to be recessed. Similar reinforcement may be placed at other portions of the upper and lower section.

The lid is typically placed under a cut away section of carpet with clear markings so that the occupants or residents can locate the shelter in a time of necessity.

Figure 8A:
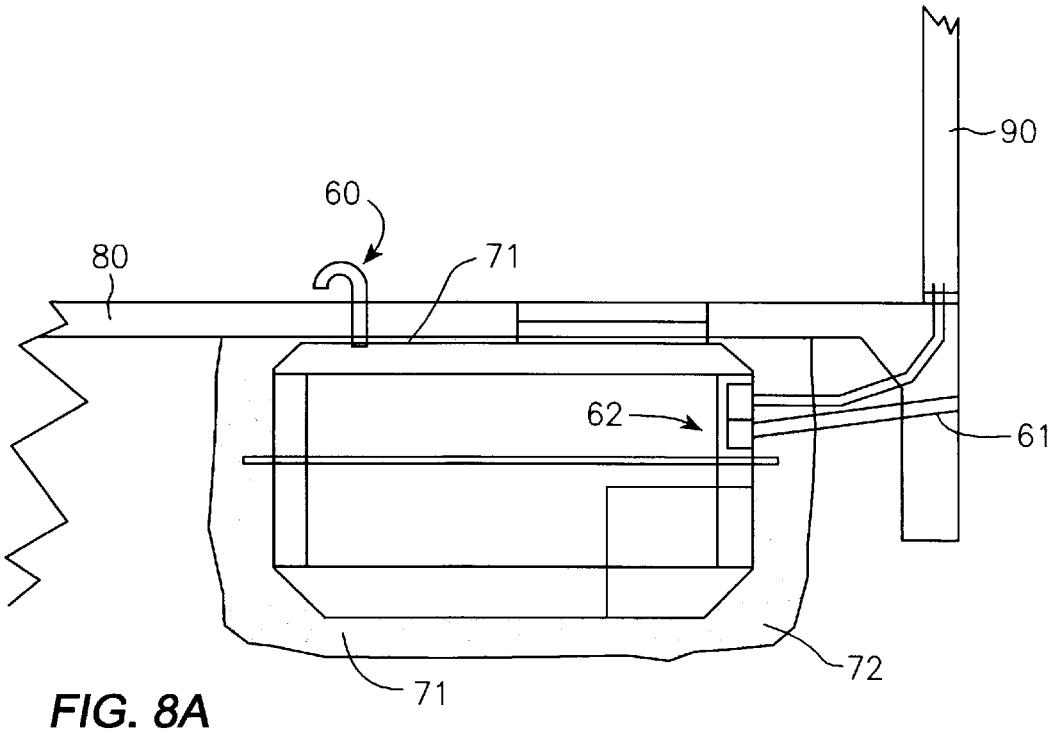
FIG. 8A is a side view of a slab installation.
Figure 8B:
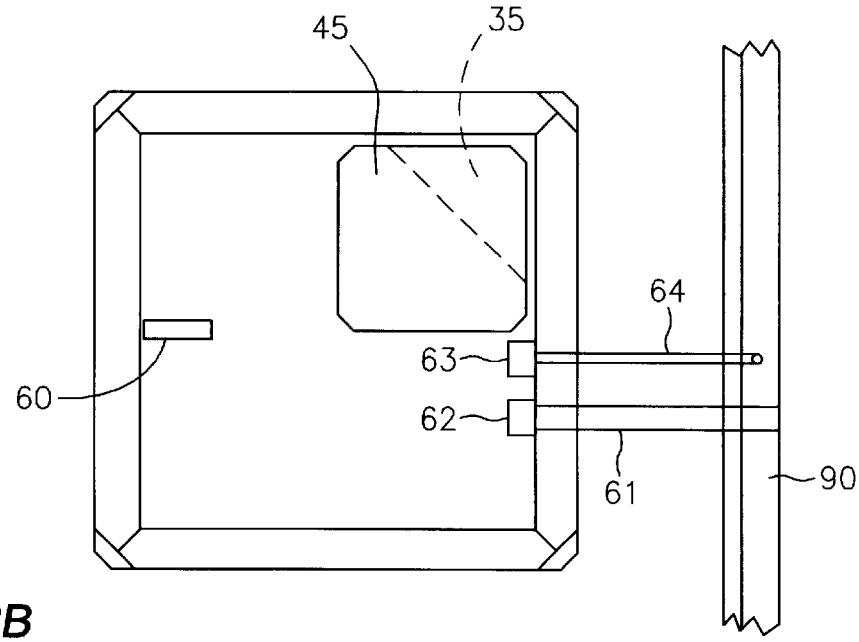
FIG. 8B is a top view of a slab installation.

Referring now to FIG. 8A and 8B, which are side and top views of the preferred installation, ventilation is provided through a vent pipe 60 and through an optional fan 62 which is vented through an external foundation wall 90. In some embodiments, a battery will be provided which will supply temporary power for ventilation and lighting. The preferred embodiment includes a conduit 64 to route lines to a junction box 63 which contains cable, electrical, and telephone outlets. It is desirable to place rechargeable flashlights and other electrical devices in the shelter, and to have a ground fault interrupt receptacle in the shelter. In the typical installation, conduit is supplied into the chamber so that wiring may be performed to support electricity for television, a telephone line, and a panic button type of signal device.

For the preferred shelter dimensions of 6' by 6' by 42" high, the foundation area is excavated to a depth of about 52" for an area approximately 7.5' square. The bottom of the excavation is then backfilled with about 5–6 inches of sand 71. The sides of the excavations are typically 1 to 2 feet wider than the main unit, and the sides are backfilled with a sand and gravel mix 72. Before the unit is place in the hole, the sand at the bottom of the pit is compacted and leveled. The grade is then taken to determine if sand should be added or removed to achieve the desired height and level of the bottom of the excavation pit. The grade will normally require at least 4 shots to determine consistency of the reading in order to verify that the bottom is level. Once the proper level and height have been obtained, the unit can be lowered into place. The preferred shelter dimensions result in a unit weight of about 300 to 350 pounds, and the unit can be positioned by 4 workmen without special equipment. After the unit is set, it is once again checked for level, and for the height of the hatch. Once the level is correct, the side fill is poured into place and compacted, and a layer of sand 71 up to ½" in thickness is placed on top of the unit. This top layer of sand permits the concrete slab to move freely. The slab is reinforced per standard design with reinforcement rods or cables.

Figure 4:
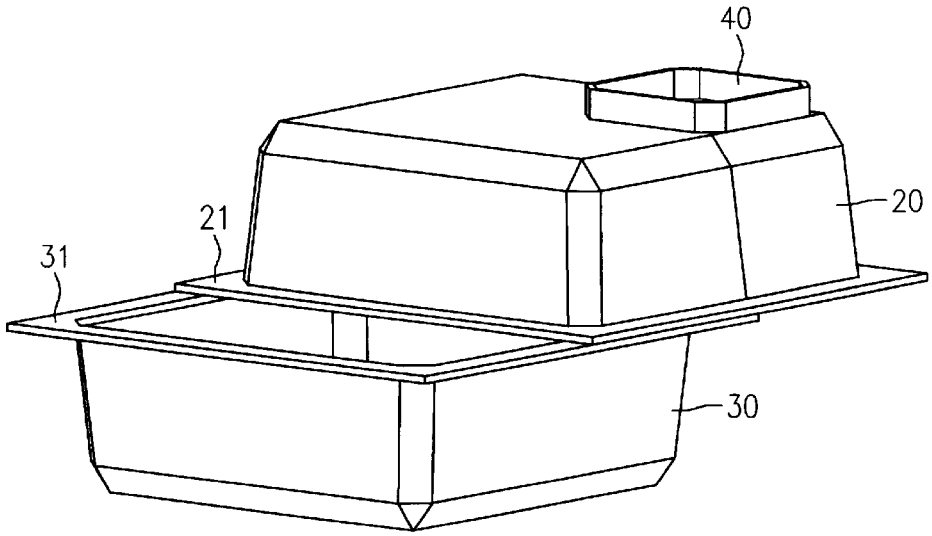
FIG. 4 is a perspective view with slight separation of the top and bottom shelter sections.

Referring now to FIG. 4, the preferred method of attaching the upper and lower sections is to bolt the sections together with stainless steel bolts and nuts at a spacing of approximately a spacing approximately 18 inches apart. At least one bead of silicon caulk is placed upon the lower section lip prior to assembly. The preferred assembly technique is to temporarily clamp the sections together while drilling at least one hole on each side of the unit. After the bolts are installed in each hole, then the temporary clamps may be removed, and the remaining holes may be drilled.

When used as a storm shelter, the occupants of a residence or other structure will move to the shelter hatch, open the lid by rotating the handle 90 degrees, and climb into the shelter. A step integral to the lower section of the shelter is used during ingress and egress. The occupants move away from the hatch area to permit additional persons to enter. Some shelters may be equipped with power ventilation and emergency power for monitoring radio or television for weather updates, and a telephone. After the last person has entered the shelter, the lid may be closed and secured by rotating the handle 90 degrees or pushing up on the lid until the spring loaded latches snap into place.

After danger has passed, the occupants open the lid by rotating the handle 90 degrees and exit the chamber.

The unit may be used as a storm shelter for tornado, hurricanes, and other severe weather; a security shelter; as an isolation chamber; as a storage compartment with relatively constant temperature; as an earthquake shelter; and as a mobile home type shelter.

ALTERNATE EMBODIMENT—SECURITY SHELTER

The unit may also serve as a temporary security shelter. In some installations, the presence of the unit may not be noticed by intruders to a home. Occupants may seek short periods of safety in the shelter by locking the door from the inside of the shelter. In some installations, a telephone will be available inside the shelter, and the phone can be used to call for assistance. A panic button may also be provided to permit an audible alarm to be activated from within the shelter.

ALTERNATE EMBODIMENT—STORAGE

The unit may also serve partially as a storage unit for occasionally used items or for items such as wine that may require a relatively constant, cool temperature.

ALTERNATE EMBODIMENT—VERTICAL EXTENSION

Figure 2B:
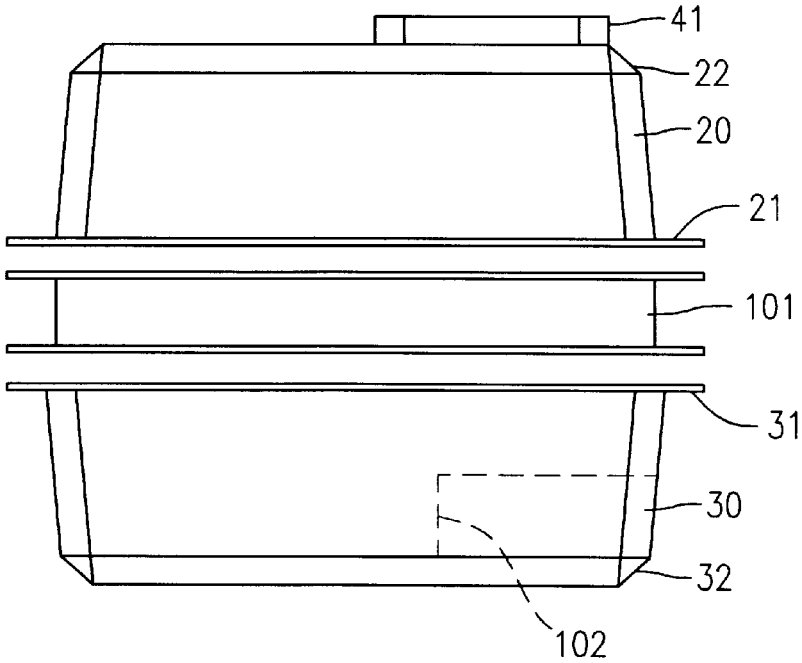
FIG. 2B is an exploded side view of the shelter with a vertical extension section.

Referring now to FIG. 2B, in cases were additional head room is desired, one or more vertical extension sections 102 may be provided. Each extension will typically be about 18" high with a lip on the top and bottom which will mate with the lips on the upper and lower sections.

What is claimed is:

1. A prefabricated fiberglass-reinforced emergency storm shelter comprised of an impervious upper section having a plurality of side walls and a top;

an impervious lower section having a plurality of side walls and a bottom, such that the lower section may be assembled to the upper section, thereby forming a unit having a total height of less than five feet, such that one or more persons can sit or crouch in the unit during times of emergency weather, and a tapered hatch extension from the upper section, the hatch extension having a bottom opening into the upper section and a top opening, such that the bottom opening is larger than the top opening and such that the shelter may be installed so that the top opening of the hatch extension is approximately flush with the floor level of a structure; and a lid means positioned in the hatch extension, such that the lid means may be only opened into the shelter.

2. The shelter of claim 1 wherein the upper and lower sections are composed of a material selected from the group consisting of fiberglass-reinforced acrylic, ABS, PVC, polyethylene, and fiberglass reinforced gel coat resin.

3. The shelter of claim 1 wherein the upper and lower sections are generally rectangular.

4. The shelter of claim 1 wherein at least one step means is formed integral to the lower section.

5. The shelter of claim 1 wherein the height of the assembled section is at least 36 inches.

6. The shelter of claim 1 wherein the upper section has a lip means along its lower periphery;

the lower section has a lip means along its upper periphery; and the shelter is assembled by attaching the upper section lip means to the lower section lip means.

7. The shelter of claim 6 wherein a vertical extension section is provided, such that the extension section has a lip means along its lower periphery which can be attached to the lower section and an upper lip means along its upper periphery which can be attached to the upper section thereby increasing the height of the assembled shelter.

8. The shelter of claim 1 wherein the upper section is slightly smaller than the lower section, such that the upper section may be inverted and nested in the lower section for shipment.

9. The shelter of claim 1 wherein the lower section is tapered such that lower sections may be stacked for shipment.

10. The shelter of claim 1 wherein the upper section is tapered such that upper sections may be stacked for shipment.

11. A prefabricated fiberglass-reinforced emergency storm shelter having a generally rectangular cross section, the shelter comprised of an upper section, approximately 6 feet wide, 6 feet long, and at least 18 inches high having an impervious acrylic inner surface, and having a lip means extending outward from its lower periphery;

a lower section, approximately 6 feet wide, 6 feet long, and at least 24 inches high having an impervious acrylic inner surface and having a lip means extending outward from its upper periphery, such that the lower section may be assembled to the upper section by attaching the lower section lip means to the upper section lip means, thereby forming a unit having a total height of at least 36", such that one or more persons can sit or crouch in the unit during times of emergency weather;

a generally rectangular hatch located in the upper section, the hatch having a length of at least 28", a width of at least 28", and extending by at least 4" above the upper section, such that the hatch maybe located approximately flush with the floor level of a structure, such that the hatch is tapered such that the hatch becomes smaller away from the shelter; and a lid means positioned in the hatch opening, such that the lid means may be opened only into the shelter.

12. The shelter of claim 11 wherein at least one step means is formed integral to the lower section.

* * * * *